US010232490B2

(12) United States Patent
Xue et al.

(10) Patent No.: US 10,232,490 B2
(45) Date of Patent: Mar. 19, 2019

(54) COMBINED WHEEL BURR REMOVING DEVICE

(71) Applicant: CITIC Dicastal CO., LTD, Qinhuangdao (CN)

(72) Inventors: Bowen Xue, Qinhuangdao (CN); Jiandong Guo, Qinhuangdao (CN)

(73) Assignee: CITIC DICASTAL CO., LTD (CN)

( * ) Notice: Subject to any disclaimer, the term of this patent is extended or adjusted under 35 U.S.C. 154(b) by 44 days.

(21) Appl. No.: 15/423,662

(22) Filed: Feb. 3, 2017

(65) Prior Publication Data

US 2018/0085886 A1 Mar. 29, 2018

(30) Foreign Application Priority Data

Sep. 24, 2016 (CN) ..... 2016 1 0845446

(51) Int. Cl.
*B24B 29/04* (2006.01)
*B24B 29/00* (2006.01)

(52) U.S. Cl.
CPC ..... *B24B 29/04* (2013.01); *B24B 29/005* (2013.01)

(58) Field of Classification Search
CPC ..... B24B 5/44; B24B 9/00; B24B 29/005; B24B 29/04
USPC ..... 451/194
See application file for complete search history.

(56) References Cited

U.S. PATENT DOCUMENTS

| | | | | |
|---|---|---|---|---|
| 3,258,804 | A * | 7/1966 | Fowle | B24B 5/225 15/104.011 |
| 5,890,952 | A * | 4/1999 | Beaupre | B23Q 3/18 451/168 |
| 5,906,537 | A * | 5/1999 | Elcock | B23C 3/30 451/194 |
| 6,217,424 | B1 * | 4/2001 | Stephens | B24B 5/44 451/254 |
| 6,722,961 | B2 * | 4/2004 | Solanellas | B23Q 1/54 451/140 |
| 9,724,796 | B2 * | 8/2017 | Xue | B24B 9/04 |
| 9,782,866 | B1 * | 10/2017 | Xue | B24B 9/04 |
| 2013/0102233 | A1 * | 4/2013 | Cheon | B24B 27/033 451/331 |
| 2016/0354891 | A1 * | 12/2016 | Xue | B24B 5/44 |

FOREIGN PATENT DOCUMENTS

| | | | |
|---|---|---|---|
| JP | H 03294136 | A * | 12/1991 |
| JP | 3044289 | B2 * | 5/2000 |

* cited by examiner

*Primary Examiner* — Marc Carlson
(74) *Attorney, Agent, or Firm* — Calfee, Halter & Griswold LLP

(57) ABSTRACT

The present invention discloses a combined wheel burr removing device, which comprises a brush lifting system, a brush driving system, roller bed parts and a clamping rotating part. When the device is used, round brushes, rolling brushes and a plurality of brush bundles can rotate respectively, so that burrs on the back cavity of a wheel can be effectively removed in different directions, and the problem that the linear speed is low in the center but high at the outer edge when an integrated brush rotates at the same angular speed can be avoided; meanwhile, the device has the characteristics of high automation degree, advanced process, simple structure and high safety and stability.

1 Claim, 3 Drawing Sheets

COMBINED WHEEL BURR REMOVING DEVICE

CROSS-REFERENCE TO RELATED APPLICATIONS

This application claims priority to Chinese Patent Application No. 201610845446.3, filed on Sep. 24, 2016, which is hereby incorporated by reference in its entirety.

TECHNICAL FIELD

The present invention relates to a burr removing device, specifically to a combined wheel burr removing device.

BACKGROUND ART

In the production process of an aluminum alloy wheel, a large amount of burrs are produced on the cutter outlet side of a spoke due to the cutting action of a cutter during machining, and the burrs, if not removed timely, may severely influence the following coating effect. At present, burrs are removed on special equipment by using a large disc brush in the traditional burr removing mode; in such a mode, when the brush rotates at certain angular speed, the linear speed of its inner bristles are much lower than the outer bristles, so that burrs are always brushed excessively or cannot be brushed; and the burrs in different directions are difficult to effectively removed in this single mode. In order to solve the phenomenon, each part of the brush must move in different speed and mode, and thus the device emerges for solving the problem.

SUMMARY OF THE INVENTION

The objective of the present invention is to provide a combined wheel burr removing device. Round brushes, rolling brushes and a plurality of brush bundles can rotate respectively, so that burrs on the back cavity of the wheel can be effectively removed in different directions, and the problem that the linear speed is low in the center but high at the outer edge when an integrated brush rotates at the same angular speed can be avoided.

In order to fulfill the above objective, the present invention adopts the technical solution: a combined wheel burr removing device is composed of a frame, a belt pulley I, a belt pulley II, a bottom plate, guide posts I, guide sleeves I, a synchronous belt I, a belt pulley III, a shaft I, a shaft II, a bearing seat I, a lower lifting plate, a bearing seat II, a shaft III, a gear I, a gear ring, gears II, shafts IV, bearing seats III, a base plate, springs, brush bundles, round brushes, pressing heads, cylinders I, a V-shaped block, a pressing plate, a shaft V, a bearing seat IV, an upper lifting plate, a motor I, guide posts II, guide sleeves II, cylinders II, bearing seats V, spline sleeves, spline shafts, chain wheels, cylinders III, supporting plates, guide rails, supports, rolling brushes, shafts VI, bearing seats VI, gears III, a gear IV, a belt pulley IV, a belt pulley V, a synchronous belt II, a motor II, cylinders IV, a synchronous belt III, a belt pulley VI and a motor III; the combined wheel burr removing device also comprises a brush lifting system, a brush driving system, each roller bed part and a clamping rotating part; the brush lifting system comprises: the two cylinders IV and the four guide sleeves I are fixed on the bottom plate; the four guide posts I matched with the four guide sleeves I are fixed below the lower lifting plate; and the output ends of the cylinders IV are articulated with the lower part of the lower lifting plate.

The brush driving system includes: the motor II is installed on the right side below the lower lifting plate via a transition flange, and the belt pulley V is installed at the output end of the motor II; the shaft III is installed inside the shaft I via a bearing, the gear IV is installed at the upper end of the shaft III, and the belt pulley I and the belt pulley II are installed at the lower end of the shaft III; the bearing seat I is fixed in the middle of the lower lifting plate; the shaft I is installed inside the bearing seat I via a bearing, the upper part of the shaft I is connected with the base plate, and the belt pulley IV is fixed at the lower part of the shaft I; the gear ring is installed outside the bearing seat I via a bearing; the bearing seat II is fixed on the left side of the lower lifting plate; the shaft II is installed inside the bearing seat II via a bearing, the gear I is installed at the upper end of the shaft II, and the belt pulley III is installed at the lower end of the shaft II; the gear I is engaged with the lower part of the gear ring; the belt pulley III is connected by the belt pulley I by the synchronous belt I; the belt pulley IV is connected with the belt pulley V by the synchronous belt H; the three bearing seats III are uniformly fixed inside the base plate in the circumferential direction, the three shafts IV are installed inside the bearing seats III via bearings, a round brush is respectively installed above the three shafts IV, a gear II is respectively installed below the three shafts IV, and the three gears II are engaged with the upper part of the gear ring; a plurality of brush bundles are installed inside the base plate, and the springs in the same quantity as the brush bundles are also installed inside the base plate and arranged below the respective brush bundles; the three bearing seats VI are uniformly installed outside the upper part of the shaft I in the circumferential direction; the three shafts VI are installed inside the bearing seats VI via bearings; the rolling brushes are respectively installed on the right sides of the three shafts VI, the gear III are respectively installed on the left sides of the three shafts VI, and the three gears III are simultaneously engaged with the gear IV; the motor III is installed on the left side below the lower lifting plate via a transition flange, the belt pulley VI is installed at the output end of the motor III, and the belt pulley VI is connected with the belt pulley I by the synchronous belt III.

Each roller bed part includes: a bearing seat V is fixed on the outer side of the frame, and a spline sleeve is installed inside the bearing seat V via a bearing; a chain wheel is installed on the right side of the spline sleeve; the right side of a spline shaft is matched with the spline sleeve, and the left side of the spline shaft is installed above a support; the support is installed above a supporting plate via a guide rail; a cylinder III is fixed on the outer side of the frame and arranged below the bearing seat V, and the output end of the cylinder III is connected with the lower part of the support; and the device includes a left roller bed part and a right roller bed part.

The clamping rotating part comprises: the V-shaped block is arranged below the pressing plate; the four cylinders I are uniformly fixed below the V-shaped block in the circumferential direction, and the pressing heads are respectively installed at the output ends of the four cylinders I; the bearing seat IV is fixed below the upper lifting plate, and the shaft V is installed inside the bearing seat IV via a bearing; the lower part of the shaft V is connected and fixed with the upper part of the pressing plate; the motor I is fixed on the upper lifting plate via a transition flange, and the output end of the motor I is connected with the shaft V; the four guide posts II are fixed on the upper lifting plate, and the four guide sleeves II matched with the four guide posts II are fixed at the top of the frame; the two cylinders II are also fixed at the top of the frame, and the output ends of the two cylinders II are articulated with the upper part of the upper lifting plate.

In actual use, the cylinders II drive the V-shaped block via the guide posts II to press the front side of the wheel, the wheel is centered and axially compacted, and the cylinders I fix the wheel via the pressing heads; the cylinders II lift the wheel via the guide posts II, and the motor I simultaneously drives the wheel to rotate via the shaft V; the cylinders III pull the supports and the spline shafts to two sides of the frame via the guide rails; the motor II drives the shaft I to rotate via the belt pulley IV, the belt pulley V and the synchronous belt II, and the shaft I drives the base plate and the plurality of brush bundles to rotate; the motor III drives the shaft III to rotate via the belt pulley VI, the belt pulley I and the synchronous belt III, and drives the belt pulley III, the shaft II and the gear I to rotate via the belt pulley II and the synchronous belt I; the gear I drives the three gears II to rotate via the gear ring, and the gears II drive the three round brushes to rotate via the three shafts IV; the gear IV drives the tree gears III and the three rolling brushes to rotate; the cylinders IV drive the rotating round brushes, rolling brushes and the plurality of brush bundles to rise via the guide posts I, and burrs can be removed when the brushes contact the back cavity of the wheel.

When the device in the present invention is used, the round brushes, the rolling brushes and the plurality of brush bundles can rotate respectively, so that burrs on the back cavity of the wheel can be effectively removed in different directions, and the problem that the linear speed is low in the center but high at the outer edge when an integrated brush rotates at the same angular speed can be avoided; meanwhile, the device has the characteristics of high automation degree, advanced process, simple structure and high safety and stability.

Figure 1:
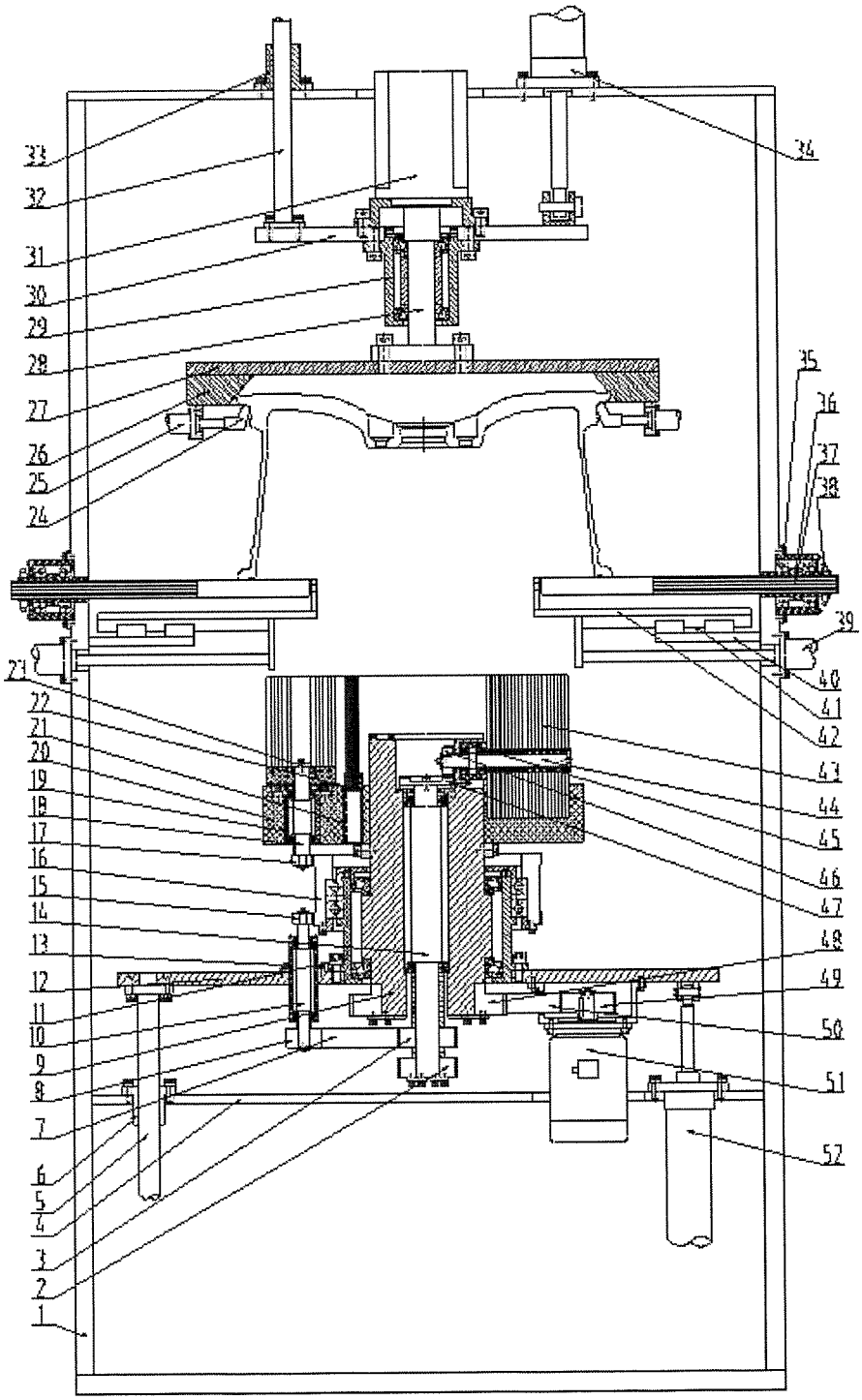
FIG. 1 is a front view of a combined wheel burr removing device of the present invention.
Figure 2:
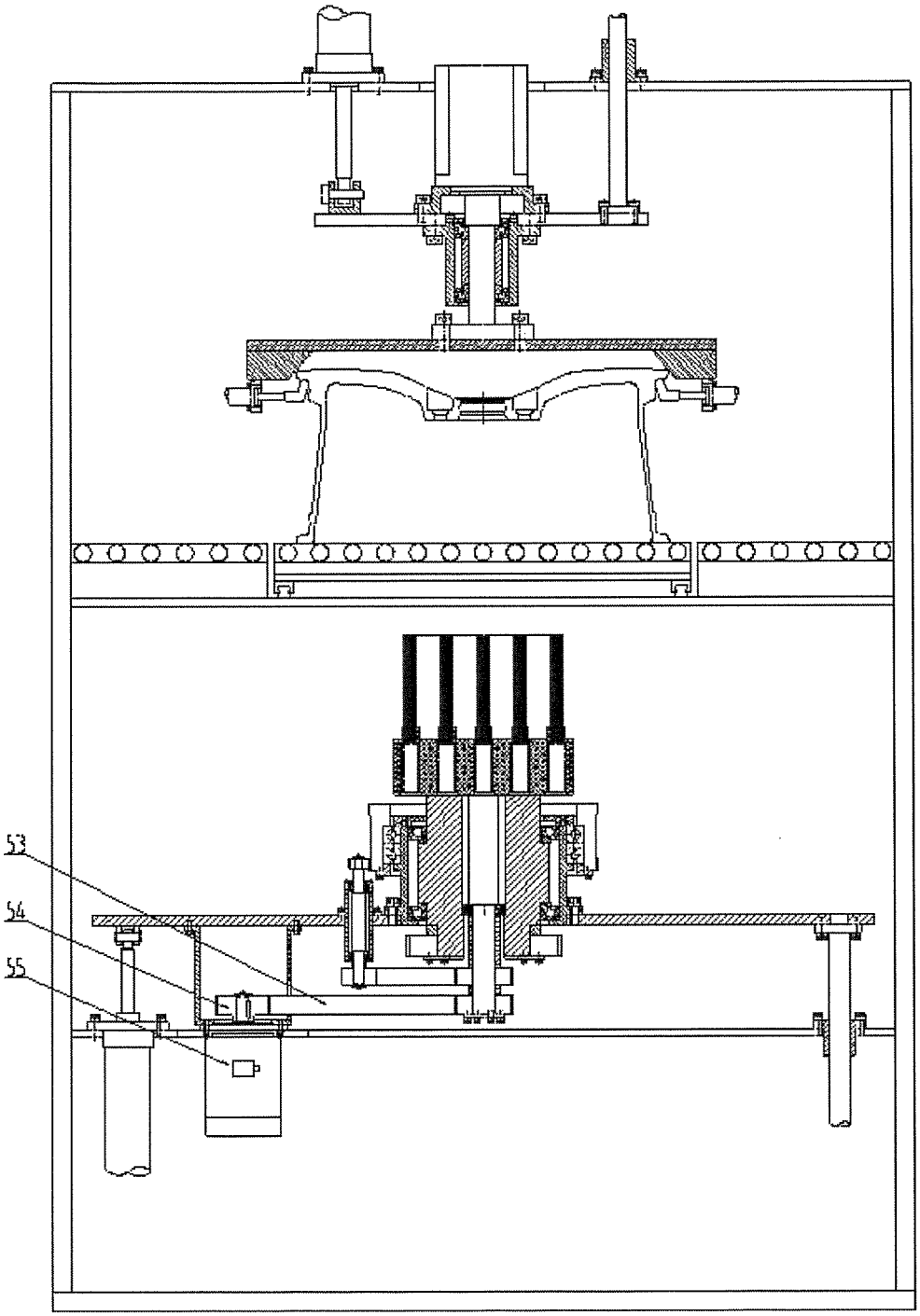
FIG. 2 is a left view of the combined wheel burr removing device of the present invention.
Figure 3:
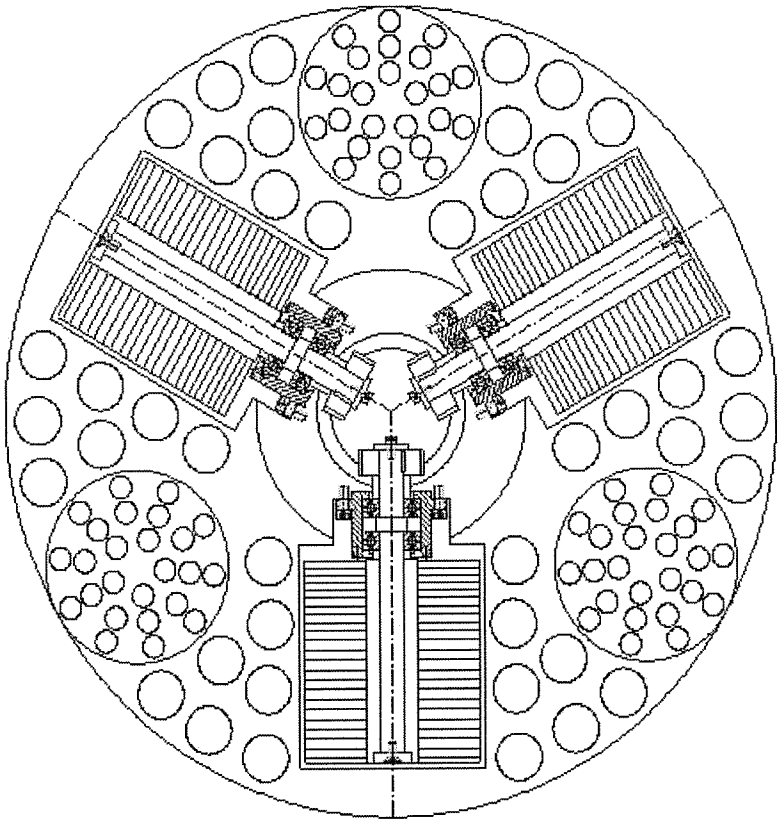
FIG. 3 is a top view of a brush part of the combined wheel burr removing device of the present invention.

In figures, numeric symbols are as follows: 1—frame, 2—belt pulley I, 3—belt pulley II, 4—bottom plate, 5—guide post I, 6—guide sleeve I, 7—synchronous belt I, 8—belt pulley III, 9—shaft I, 10—shaft II, 11—bearing seat I, 12—lower lifting plate, 13—bearing seat II, 14—shaft III, 15—gear I, 16—gear ring, 17—gear II, 18—shaft IV, 19—bearing seat III, 20—base plate, 21—spring, 22—brush bundle, 23—round brush, 24—pressing head, 25—cylinder I, 26—V—shaped block, 27—pressing plate, 28—shaft V, 29—bearing seat IV, 30—upper lifting plate, 31—motor I, 32—guide post II, 33—guide sleeve II, 34—cylinder II, 35—bearing seat V, 36—spline sleeve, 37—spline shaft, 38—chain wheel, 39—cylinder III, 40—supporting plate, 41—guide rail, 42—support, 43—rolling brush, 44—shaft VI, 45—bearing seat VI, 46—gear III, 47—gear IV, 48—belt pulley IV, 49—belt pulley V, 50—synchronous belt II, 51—motor II, 52—cylinder IV, 53—synchronous belt III, 54—belt pulley VI, 55—motor III.

DETAILED DESCRIPTION OF THE INVENTION

Details and working conditions of a specific device provided by the present invention will be described below in combination with the accompanying drawings.

The device is composed of a frame 1, a belt pulley I 2, a belt pulley II 3, a bottom plate 4, guide posts I 5, guide sleeves I 6, a synchronous belt I 7, a belt pulley III 8, a shaft I 9, a shaft II 10, a bearing seat I 11, a lower lifting plate 12, a bearing seat II 13, a shaft III 14, a gear I 15, a gear ring 16, gears II 17, shafts IV 18, bearing seats III 19, a base plate 20, springs 21, brush bundles 22, round brushes 23, pressing heads 24, cylinders I 25, a V-shaped block 26, a pressing plate 27, a shaft V 28, a bearing seat IV 29, an upper lifting plate 30, a motor I 31, guide posts II 32, guide sleeves II 33, cylinders II 34, bearing seats V 35, spline sleeves 36, spline shafts 37, chain wheels 38, cylinders III 39, supporting plates 40, guide rails 41, supports 42, rolling brushes 43, shafts VI 44, bearing seats VI 45, gears III 46, a gear IV 47, a belt pulley IV 48, a belt pulley V 49, a synchronous belt II 50, a motor II 51, cylinders IV 52, a synchronous belt III 53, a belt pulley VI 54 and a motor III 55, wherein a brush lifting system includes: the two cylinders IV 52 and the four guide sleeves I 6 are fixed on the bottom plate 4; the four guide posts I 5 matched with the four guide sleeves I 6 are fixed below the lower lifting plate 12; the output ends of the cylinders IV 52 are articulated with the lower part of the lower lifting plate 12.

A brush driving system includes: the motor II 51 is installed on the right side below the lower lifting plate 12 via a transition flange, and the belt pulley V 49 is installed at the output end of the motor II 51; the shaft III 14 is installed inside the shaft I 9 via a bearing, the gear IV 47 is installed at the upper end of the shaft III 14, and the belt pulley I 2 and the belt pulley II 3 are installed at the lower end of the shaft III 14; the bearing seat I 11 is fixed in the middle of the lower lifting plate 12; the shaft I 9 is installed inside the bearing seat I 11 via a bearing, the upper part of the shaft I 9 is connected with the base plate 20, and the belt pulley IV 48 is fixed at the lower part of the shaft I 9; the gear ring 16 is installed outside the bearing seat I 11 via a bearing; the bearing seat II 13 is fixed on the left side of the lower lifting plate 12; the shaft II 10 is installed inside the bearing seat II 13 via a bearing, the gear I 15 is installed at the upper end of the shaft II 10, and the belt pulley III 8 is installed at the lower end of the shaft II 10; the gear I 15 is engaged with the lower part of the gear ring 16; the belt pulley III 8 is connected with the belt pulley I 2 by the synchronous belt I 7; the belt pulley IV 48 is connected with the belt pulley V 49 by the synchronous belt II 50; the three bearing seats III 19 are uniformly fixed inside the base plate 20 in the circumferential direction, the three shafts IV 18 are installed inside the bearing seats III 19 via bearings, the round brushes 23 are respectively installed above the three shafts IV 18, the gears II 17 are respectively installed below the three shafts IV 18, and the three gears II 17 are engaged with the upper part of the gear ring 16; a plurality of brush bundles 22 are installed inside the base plate 20, and the springs 21 in the same quantity as the brush bundles 22 are also installed inside the base plate 20 and arranged below the respective brush bundles 22; the three bearing seats VI 45 are uniformly installed outside the upper part of the shaft I 9 in the circumferential direction; the three shafts VI 44 are installed inside the bearing seats VI 45 via bearings; the rolling brushes 43 are respectively installed on the right sides of the three shafts VI 44, the gears III 46 are respectively installed on the left sides of the three shafts VI 44, and the three gears III 46 are simultaneously engaged with the gear IV 47; the motor III 55 is installed on the left side below the lower lifting plate 12 via a transition flange, the belt pulley VI 54 is installed at the output end of the motor III 55, and the belt pulley VI 54 is connected with the belt pulley I 2 by the synchronous belt III 53.

Each roller bed part includes: a bearing seat V 35 is fixed on the outer side of the frame 1, and a spline sleeve 36 is installed inside the bearing seat V 35 via a bearing; a chain wheel 38 is installed on the right side of the spline sleeve 36; the right side of a spline shaft 37 is matched with the spline sleeve 36, and the left side of the spline shaft 37 is installed above a support 42; the support 42 is installed above a supporting plate 40 via a guide rail 41; a cylinder III 39 is fixed on the outer side of the frame 1 and arranged below the bearing seat V 35, and the output end of the cylinder III 39 is connected with the lower part of the support 42; the device includes a left roller bed part and a right roller bed part.

The V-shaped block 26 is arranged below the pressing plate 27; the four cylinders I 25 are uniformly fixed below the V-shaped block 26 in the circumferential direction, and the pressing heads 24 are respectively installed at the output ends of the four cylinders I 25; the bearing seat IV 29 is fixed below the upper lifting plate 30, and the shaft V 28 is installed inside the bearing seat IV 29 via a bearing; the lower part of the shaft V 28 is connected and fixed with the upper part of the pressing plate 27; the motor I 31 is fixed on the upper lifting plate 30 via a transition flange, and the output end of the motor I 31 is connected with the shaft V 28; the four guide posts II 32 are fixed on the upper lifting plate 30, and the four guide sleeves II 33 matched with the four guide posts II 32 are fixed at the top of the frame 1; the two cylinders II 34 are also fixed at the top of the frame 1, and the output ends of the two cylinders II 34 are articulated with the upper part of the upper lifting plate 30.

In the working process, the cylinders II 34 drive the V-shaped block 26 via the guide posts II 32 to press the front side of the wheel, the wheel is centered and axially compacted, and the cylinders I 25 fix the wheel via the pressing heads 24; the cylinders II 34 lift the wheel via the guide posts II 32, and the motor I 31 simultaneously drives the wheel to rotate via the shaft V 28; the cylinders III 39 pull the supports 42 and the spline shafts 37 to two sides of the frame 1 via the guide rails 41; the motor II 51 drives the shaft I 9 to rotate via the belt pulley IV 48, the belt pulley V 49 and the synchronous belt II 50, and the shaft I 9 drives the base plate 20 and the plurality of brush bundles 22 to rotate; the motor III 55 drives the shaft III 14 to rotate via the belt pulley VI 54, the belt pulley I 2 and the synchronous belt III 53, and drives the belt pulley III 8, the shaft II 10 and the gear I 15 to rotate via the belt pulley II 3 and the synchronous belt I 7; the gear I 15 drives the three gears II 17 to rotate via the gear ring 16, and the gears II 17 drive the three round brushes 23 to rotate via the three shafts IV 18; the gear IV 47 drives the tree gears III 46 and the three rolling brushes 43 to rotate; the cylinders IV 52 drive the rotating round brushes 23, rolling brushes 43 and the plurality of brush bundles 22 to rise via the guide posts I 5, and burrs can be removed when the brushes contact the back cavity of the wheel.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A combined wheel burr removing device, comprising a frame, a belt pulley I, a belt pulley II, a bottom plate, four guide posts I, four guide sleeves I, a synchronous belt I, a belt pulley III, a shaft I, a shaft II, a bearing seat I, a lower lifting plate, a bearing seat II, a shaft III, a gear I, a gear ring, three gears II, three shafts IV, three bearing seats III, a base plate, springs, brush bundles, round brushes, pressing heads, four cylinders I, a V-shaped block, a pressing plate, a shaft V, a bearing seat IV, an upper lifting plate, a motor I, four guide posts II, four guide sleeves II, two cylinders II, bearing seats V, spline sleeves, spline shafts, chain wheels, cylinders III, supporting plates, guide rails, supports, rolling brushes, three shafts VI, three bearing seats VI, three gears III, a gear IV, a belt pulley IV, a belt pulley V, a synchronous belt II, a motor II, two cylinders IV, a synchronous belt III, a belt pulley VI and a motor III, wherein the combined wheel burr removing device also comprises a brush lifting system, a brush driving system, each roller bed part and a clamping rotating part;

the brush lifting system comprises: the two cylinders IV and the four guide sleeves I are fixed on the bottom plate; the four guide posts I matched with the four guide sleeves I are fixed below the lower lifting plate; output ends of the two cylinders IV are articulated with a lower part of the lower lifting plate;

the brush driving system comprises: the motor II is installed on a right side below the lower lifting plate via a transition flange, and the belt pulley V is installed at an output end of the motor II; the shaft III is installed inside the shaft I via a bearing, the gear IV is installed at an upper end of the shaft III, and the belt pulley I and the belt pulley II are installed at a lower end of the shaft III; the bearing seat I is fixed in a middle of the lower lifting plate; the shaft I is installed inside the bearing seat I via a bearing, an upper part of the shaft I is connected with the base plate, and the belt pulley IV is fixed at a lower part of the shaft I; the gear ring is installed outside the bearing seat I via a bearing; the bearing seat II is fixed on a left side of the lower lifting plate; the shaft II is installed inside the bearing seat II via a bearing, the gear I is installed at an upper end of the shaft II, and the belt pulley III is installed at a lower end of the shaft II; the gear I is engaged with a lower part of the gear ring; the belt pulley III is connected with the belt pulley I by the synchronous belt I; the belt pulley IV is connected with the belt pulley V by the synchronous belt II; the three bearing seats III are uniformly fixed inside the base plate in a circumferential direction, the three shafts IV are installed inside the bearing seats III via bearings, the round brushes are respectively installed above the three shafts IV, the three gears II are respectively installed below the three shafts IV, and the three gears II are engaged with an upper part of the gear ring; a plurality of brush bundles are installed inside the base plate, and the springs in the same quantity as the brush bundles are also installed inside the base plate and arranged below the respective brush bundles; the three bearing seats VI are uniformly installed outside the upper part of the shaft I in the circumferential direction; the three shafts VI are installed inside the bearing seats VI via bearings; the rolling brush are respectively installed on right sides of the three shafts VI, the three gears III are respectively installed on left sides of the three shafts VI, and the three gears III are simultaneously engaged with the gear IV; the motor III is installed on a left side below the lower lifting plate via a transition flange, the belt pulley VI is installed at an output end of the motor III, and the belt pulley VI is connected with the belt pulley I by the synchronous belt III;

each roller bed part comprises: the bearing seat V is fixed on the outer side of the frame, and each of the spline sleeves is installed inside the bearing seat V via a bearing; each of the chain wheels is installed on a right side of each of the spline sleeves; a right side of each of the spline shafts is matched with each of the spline sleeves, and a left side of each of the spline shafts is installed above each of the supports; each of the supports is installed above each of the supporting plates via the guide rail; each of the cylinders III is fixed on the outer side of the frame and arranged below the bearing seat V, and an output end of the cylinder III is connected with a lower part of each of the supports; the device comprises a left roller bed part and a right roller bed part;

the clamping rotating part comprises: the V-shaped block is arranged below the pressing plate; the four cylinders I are uniformly fixed below the V-shaped block in the circumferential direction, and the pressing heads are respectively installed at output ends of the four cylinders I; the bearing seat IV is fixed below the upper lifting plate, and the shaft V is installed inside the bearing seat IV via a bearing; a lower part of the shaft V is connected and fixed with an upper part of the pressing plate; the motor I is fixed on the upper lifting plate via a transition flange, and an output end of the motor I is connected with the shaft V; the four guide posts II are fixed on the upper lifting plate, and the four guide sleeves II matched with the four guide posts II are fixed at the top of the frame; the two cylinders II are also fixed at the top of the frame, and output ends of the two cylinders II are articulated with an upper part of the upper lifting plate, wherein the two cylinders II drive the V-shaped block via the guide posts II to press a front side of the wheel, the wheel is centered and axially compacted, and the four cylinders I fix the wheel via the pressing heads; the two cylinders II lift the wheel via the guide posts II, and the motor I simultaneously drives the wheel to rotate via the shaft V, the cylinders III pull the supports and the spline shafts to two sides of the frame via the guide rails; the motor II drives the shaft Ito rotate via the belt pulley IV, the belt pulley V and the synchronous belt II, and the shaft I drives the base plate and the plurality of brush bundles to rotate; the motor III drives the shaft III to rotate via the belt pulley VI, the belt pulley I and the synchronous belt III, and drives the belt pulley III, the shaft II and the gear Ito rotate via the belt pulley II and the synchronous belt I; the gear I drives the three gears II to rotate via the gear ring, and the gears II drive the three round brushes to rotate via the three shafts IV, the gear IV drives the tree gears III and the three rolling brushes to rotate; the two cylinders IV drive the rotating round brushes, rolling brushes and the plurality of brush bundles to rise via the guide posts I, and burrs can be removed when the brushes contact a back cavity of the wheel.

* * * * *